US008881988B2

(12) United States Patent
Miceli et al.

(10) Patent No.: US 8,881,988 B2
(45) Date of Patent: Nov. 11, 2014

(54) METHOD OF PROVIDING CUSTOM INFORMATION TO USERS OF PHARMACEUTICAL STORAGE SYSTEMS

(71) Applicant: Tri State Distribution, Inc., Sparta, TN (US)

(72) Inventors: David A. Miceli, Reno, NV (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 159 days.

(21) Appl. No.: 13/680,435

(22) Filed: Nov. 19, 2012

(65) Prior Publication Data

US 2013/0313817 A1 Nov. 28, 2013

Related U.S. Application Data

(63) Continuation-in-part of application No. 13/664,887, filed on Oct. 31, 2012, now Pat. No. 8,662,331, which is a continuation-in-part of application No. 29/430,710, filed on Aug. 29, 2012, now Pat. No. Des. 709,766, which is a continuation-in-part of application No. 29/422,544, filed on May 22, 2012, now Pat. No. Des. 679,598, and a continuation-in-part of application No. 29/422,556, filed on May 22, 2012, now Pat. No. Des. 680,001.

(51) Int. Cl.

| | |
|---|---|
| ***B65D 55/02*** | (2006.01) |
| ***B42D 15/00*** | (2006.01) |
| ***B65D 41/04*** | (2006.01) |
| ***B65D 50/06*** | (2006.01) |
| ***B65D 51/24*** | (2006.01) |

(52) U.S. Cl.

CPC ..... *B42D 15/00* (2013.01); *B65D 41/04* (2013.01); *B65D 50/06* (2013.01); *B65D 51/245* (2013.01); *B65D 2215/04* (2013.01)

USPC ..... 235/487; 215/219

(58) Field of Classification Search

USPC ..... 235/487; 215/219, 221

See application file for complete search history.

(56) References Cited

U.S. PATENT DOCUMENTS

| | | | |
|---|---|---|---|
| 3,865,267 | A | 2/1975 | Morris |
| 4,103,797 | A | 8/1978 | Morris |
| D266,906 | S | 11/1982 | Guerette |
| 4,452,364 | A | 6/1984 | Kay |
| 4,526,281 | A | 7/1985 | Herr |

(Continued)

FOREIGN PATENT DOCUMENTS

| | | | |
|---|---|---|---|
| WO | 2006080945 | A1 | 8/2006 |

*Primary Examiner* — Daniel Hess

(74) *Attorney, Agent, or Firm* — Luedeka Neely Group, P.C.

(57) ABSTRACT

A method for providing custom information to a user of a reversible child resistant closure includes maintaining a supply of closures, each closure including a first section configured to be applied to the container in a non-child resistant mode, a second section configured to be applied to the container in a child resistant mode, and a divider for forming a first section cavity and a second section cavity. One of the closures of the supply is configured to include printed information by inserting a first liner having indicia printed thereon in the first section cavity such that the indicia of the first liner is visible when the closure is installed in the child resistant mode and inserting a second liner having indicia printed thereon in the second section cavity such that the indicia of the second liner is visible when the closure is installed in the non-child resistant mode.

21 Claims, 14 Drawing Sheets

(56) References Cited

U.S. PATENT DOCUMENTS

| | | | |
|---|---|---|---|
| D315,507 | S | 3/1991 | Ochs |
| D318,804 | S | 8/1991 | Ochs |
| 5,092,477 | A | 3/1992 | Johnson et al. |
| 5,115,929 | A | 5/1992 | Buono |
| 5,329,713 | A | 7/1994 | Lundell |
| 5,342,093 | A | 8/1994 | Weemink |
| 5,464,110 | A | 11/1995 | Heyworth |
| 5,579,934 | A | 12/1996 | Buono |
| 5,711,442 | A | 1/1998 | Kusz |
| 5,899,348 | A | 5/1999 | Konefal et al. |
| 5,927,532 | A | 7/1999 | Traub |
| 5,958,536 | A | 9/1999 | Gelsinger et al. |
| 6,036,231 | A | 3/2000 | Foote et al. |
| 6,039,195 | A | 3/2000 | Konefal et al. |
| 6,240,394 | B1 | 5/2001 | Uecker et al. |
| 6,254,952 | B1 | 7/2001 | Fox et al. |
| 6,327,770 | B1 | 12/2001 | Konefal et al. |
| 6,368,688 | B1 | 4/2002 | Crum et al. |
| 6,446,823 | B2 | 9/2002 | Miceli et al. |
| 6,523,709 | B2 | 2/2003 | Miceli et al. |
| 6,715,796 | B2 | 4/2004 | Foote et al. |
| 6,802,427 | B2 | 10/2004 | Miceli et al. |
| 6,926,161 | B2 | 8/2005 | Miceli et al. |
| 7,000,789 | B2 | 2/2006 | Miceli et al. |
| 7,111,746 | B2 | 9/2006 | Miceli et al. |
| 7,124,904 | B1 | 10/2006 | Miceli et al. |
| D548,081 | S | 8/2007 | Noonan |
| 7,401,706 | B2 | 7/2008 | Shingle |
| D574,239 | S | 8/2008 | Lin |
| 7,823,726 | B1 | 11/2010 | Miceli et al. |
| 7,891,509 | B2 | 2/2011 | Konefal |
| 8,006,852 | B1 | 8/2011 | Miceli et al. |
| 8,181,370 | B1 | 5/2012 | Mlceli et al. |
| 2003/0112466 | A1 | 6/2003 | Leonardi |
| 2006/0163869 | A1 | 7/2006 | Adler et al. |
| 2008/0262930 | A1 | 10/2008 | Miceli et al. |
| 2009/0140513 | A1 | 6/2009 | Priebe et al. |
| 2010/0252474 | A1 | 10/2010 | Miceli et al. |

METHOD OF PROVIDING CUSTOM INFORMATION TO USERS OF PHARMACEUTICAL STORAGE SYSTEMS

CROSS-REFERENCE TO RELATED APPLICATIONS

This application is a continuation-in-part to co-pending U.S. application Ser. No. 13/664,887 filed Oct. 31, 2012, and entitled "One Piece Reversible Closure and Container System, which claimed priority as a continuation-in-part of U.S. Design application Ser. No. 29/430,710 filed Aug. 29, 2012, and entitled "Pharmaceutical Cap," which claimed priority as a continuation-in-part of U.S. Design application Ser. No. 29/422,544 and U.S. Design application Ser. No. 29/422,556, both of which were filed May 22, 2012, and entitled "Pharmaceutical Cap," the contents of which are incorporated by reference herein in their entireties.

FIELD

This disclosure relates to a reversible child resistant closure. More particularly, this disclosure relates to a one-piece reversible child resistant closure which may be applied to a vial or other container in either a child resistant mode or a non-child resistant mode and custom liner inserts to be used with the closure.

BACKGROUND

There are many types of child resistant closure systems described in the art. While many child resistant caps effectively provide protection against the danger of small children being able to remove potentially harmful contents, e.g. pills, from vials or other containers, they also provide a problem for a considerable portion of the adult population that require medication but lack sufficient manual dexterity or strength to remove the child resistant cap. This is of a particular concern to the elderly population or people suffering from arthritis and other disabling diseases.

Continuous threaded, torque actuated child resistant caps are a popular type of child resistant closures. These caps involve the use of two parts, one part rests above the other part in an axial configuration and requires both a rotational and downward action to engage for removal. These caps are used in literally thousands of various applications and packaging configurations due to the universally understood push and turn structures and ease of use and adaptation in a wide variety of automated filing lines and processes. Most of these prior art torque actuated child resistant closures are continuously in a child resistant mode and, therefore, can pose a problem to the segment of the population needing the pharmaceuticals contained therein, but lacking the manual dexterity or strength to open the axially, torque actuated closures.

This particular problem has been addressed by the development of closure systems having both a child resistant mode and a non-child resistant mode such that, in the non-child resistant mode, the closures are more easily opened by adults. However, many such caps have a complex, multipart structure making the caps expensive and/or difficult to convert between the child resistant and non-child resistant configurations. One example of such a closure is disclosed in U.S. Pat. No. 5,579,934, (the '934 patent). The '934 patent proposes a container closure that is selectively manipulatable between a configuration which resists opening by children and a configuration which may be easily opened without special manipulation of the closure. Specifically, the closure is manipulated into its non-child resistant mode by "pressing down" on the central portion of the top surface of the closure.

Although this type of closure provides an advance in the art of protection against the danger of small children being able to remove it from vials or other containers, the cap is made with two separately manufactured pieces that must be assembled. These aspects of the cap of the '934 patent, as well as other caps sharing these aspects, increases both the manufacturing cost and assembly time for the caps. Further, these caps cannot be sealed with tamper resistant liners in an induction sealing process as the two-piece cap includes an inner component that protrudes into the opening of the container and would break the seal.

Additionally, many caps that are convertible between a child resistant mode and non-child resistant mode have lacked the capability to properly include a warning to the consumer once this closure has been converted to its non-child resistant configuration. This warning, or message, is normally required by the Consumer Product Safety Commission to alert users that the closure has been converted into the non-child resistant configuration.

In light of the foregoing, what is needed in the art is a reversible one piece child resistant closure and one piece child resistant closure and container system that is efficient to manufacture and use. The closure and container system preferably should provide a warning to the user when the closure system is in a non-child resistant mode and is operable to be used in conjunction with an induction sealing system.

SUMMARY

A method is disclosed for providing custom information to a user of a reversible child resistant closure operable to be applied to a container in one of a child resistant mode and a non-child resistant mode. The method includes the steps of maintaining a supply of closures, each closure including a first section configured to be applied to the container in the non-child resistant mode, a second section configured to be applied to the container in the child resistant mode, and a divider disposed between the first section and the second section for forming a first section cavity and a second section cavity; and configuring one of the closures of the supply to include printed information by inserting a first liner having indicia printed thereon in the first section cavity of the closure such that the indicia of the first liner is visible when the closure is installed on the container in the child resistant mode and inserting a second liner having indicia printed thereon in the second section cavity of the closure such that the indicia of the second liner is visible when the closure is installed on the container in the non-child resistant mode.

According to some embodiments, the closure includes a circumferential side wall having a side wall diameter, the first liner and the second liner being shaped in the form of a disc having a liner diameter substantially the same as the side wall diameter. In some embodiments, indicia of the second liner includes warning information indicating that the closure is in the non-child resistant mode. Indicia of at least one of the first liner and the second liner may also include promotional information or prescription information.

According to certain embodiments, the method further includes providing a plurality of liners each having different indicia information printed thereon, the indicia information including at least one of warning information, operating instructions, prescription information, and promotional information; selecting the first liner based on the desired indicia information to be directed to the user when the closure is installed on the container in the child resistant mode; and selecting the second liner based on the desired indicia information to be directed to the user when the closure is installed on the container in the non-child resistant mode.

According to some embodiments, the method further includes maintaining a database of custom liner designs, each liner design including custom information to be printed on a liner insert, the custom information including at least one of promotional information and prescription information; selecting from the database of custom liner designs a first liner design and a second liner design, the indicia of the first liner corresponding to the custom information of the first liner design and the indicia of the second liner corresponding to the custom information of the second liner design; printing the first liner design on the first liner prior to inserting the first liner in the first section cavity; and printing the second liner design on the second liner prior to inserting the second liner in the second section cavity. In certain embodiments, the custom information of the first liner design is substantially similar to the custom information of the second liner design. In other embodiments, the custom information of the first liner design is different than the custom information of the second liner design. In some embodiments, the custom information of at least one of the first liner design and the second liner design includes dosage instructions corresponding to a pharmaceutical being prescribed. In certain embodiments, the dosage instructions are automatically selected by a computer system from the database based on the pharmaceutical being prescribed.

According to another embodiment of the disclosure, a method of providing customized information to a user of a pharmaceutical storage system includes maintaining at a pharmacy a supply of closures, each closure including a first section configured to be applied to a container in a non-child resistant mode and a second section configured to be applied to the container in a child resistant mode, the first section including a first section cavity configured to receive a first liner insert and the second section including a second section cavity configured to receive a second liner insert; maintaining a plurality of liner inserts each having custom information printed thereon, the custom information including at least one of warning information, promotional information, operating instructions, and prescription information; and configuring one of the closures of the supply to include custom printed information. The configuring step includes selecting a first liner insert from the plurality of liner inserts based on desired custom information to be directed to the user when the closure is applied to the container in the child resistant mode; selecting a second liner insert from the plurality of liner inserts based on desired custom information to be directed to the user when the closure is applied to the container in the non-child resistant mode; inserting the first liner insert in the first section cavity such that the desired custom information of the first liner insert is visible when the closure is applied to the container in the child resistant mode, and inserting the second liner insert in the second section cavity such that the desired custom information of the second liner insert is visible when the closure is applied to the container in the non-child resistant mode.

According to certain embodiments, the method further includes receiving at the pharmacy the plurality of liner inserts from a third party.

According to some embodiments, the plurality of liner inserts includes a group of inserts including at least warning information indicating that the closure is in the non-child resistant mode and wherein the second liner insert is selected from the first group of inserts. The plurality of liner inserts may also include a group of inserts having at least dosage information for a plurality of pharmaceutical prescriptions and wherein at least one of the first and second liner inserts is selected from the group of inserts based on an appropriate dosage of a pharmaceutical prescribed to the user of the pharmaceutical storage system and/or a group of inserts having promotional information directed to one of goods or services offered by the pharmacy, goods or services that are related to a prescribed pharmaceutical, and goods or services offered by a company geographically related to the pharmacy.

According to another embodiment, a method of providing information to a user of a reversible child resistant closure operable to be applied to a container in one of a child resistant mode and a non-child resistant mode includes maintaining a supply of closures, the closures including a first section configured to be applied to the container in the non-child resistant mode, a second section configured to be applied to the container in the child resistant mode, and a solid divider disposed between the first section and the second section for forming a first section cavity and a second section cavity and for closing an opening of the container when the closure is installed on the container in the non-child resistant mode and the child resistant mode, the solid divider being at least partially transparent; and configuring one of the closures of the supply to include printed information by inserting a liner having a first side and a second side into one of the first section cavity and the second section cavity adjacent and parallel to the solid divider such that the first side is viewable when the closure is applied to the container in the non-child resistant mode and the second side is viewable when the closure is applied to the container in the child resistant mode.

According to certain embodiments, the first side of the liner includes warning information indicating that the closure is applied to the container in a non-child resistant mode and/or at least one of the first side and the second side of the liner includes promotional information or prescription information.

According to yet another embodiment of the disclosure, a method of providing customized information to a user of a pharmaceutical storage system includes maintaining a supply of closures, each closure including at least a first section cavity configured to receive a liner insert; maintaining a plurality of liner inserts each having custom information printed thereon, the custom information including at least one of warning information, promotional information, operating instructions, and prescription information; and configuring one of the closures of the supply to include custom printed information. The configuring step includes selecting a first liner insert from the plurality of liner inserts based on desired custom information to be directed to the user when the closure is applied to the container and inserting the first liner insert in the first section cavity such that the desired custom information of the first liner insert is visible when the closure is applied to the container in one of a child resistant mode and a non-child resistant mode.

According to certain embodiments, the first liner insert is inserted into the first section cavity such that the desired custom information of the first liner insert is visible when the closure is applied to the container in the non-child resistant mode. In some embodiments, each closure includes a first section, a second section, and a divider disposed between the first section and the second section, and the method further includes printing indicia on the divider such that the indicia is visible when the closure is applied to the container in the child resistant mode.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The disclosure relates to a reversible child resistant closure system primarily directed for use with containers intended to store and dispense pharmaceutical products and the like. However, the system may also be used with containers intended to have a child resistant mode and a non-child resistant mode irrespective of its contents.

Figure 1A:
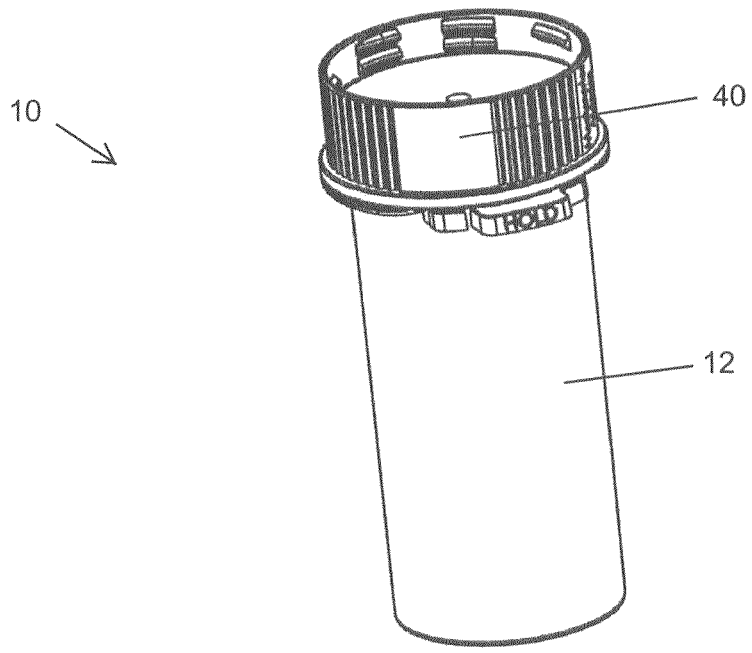
FIG. 1A is a side perspective view of a reversible child resistant closure system in a child resistant mode according to one embodiment of the disclosure.
Figure 1B:
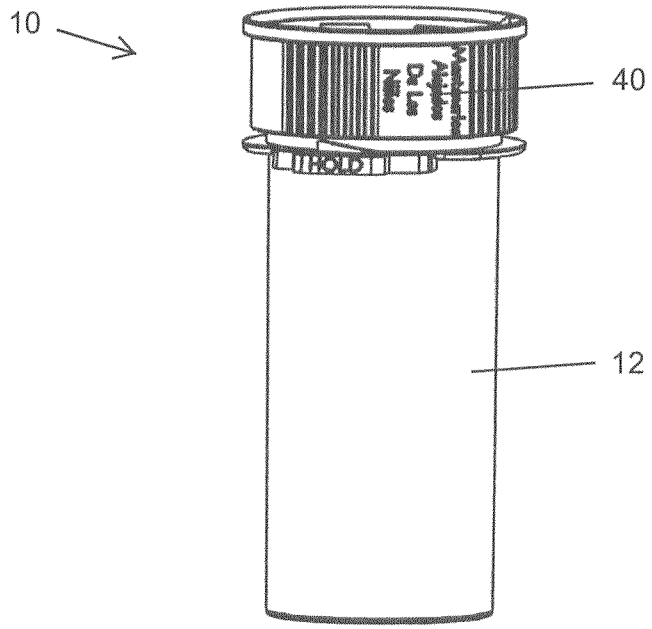
FIG. 1B is a side perspective view of a reversible child resistant closure system in a non-child resistant mode according to one embodiment of the disclosure.

Referring first to FIGS. 1A-1B, there is shown a reversible child resistant closure system 10 according to the disclosure. FIG. 1A shows the closure system 10 in its child resistant mode, and FIG. 1B shows the same closure system 10 in its non-child resistant mode. The closure system 10 includes a container 12 and a one piece reversible child resistant closure 40.

Figure 2:
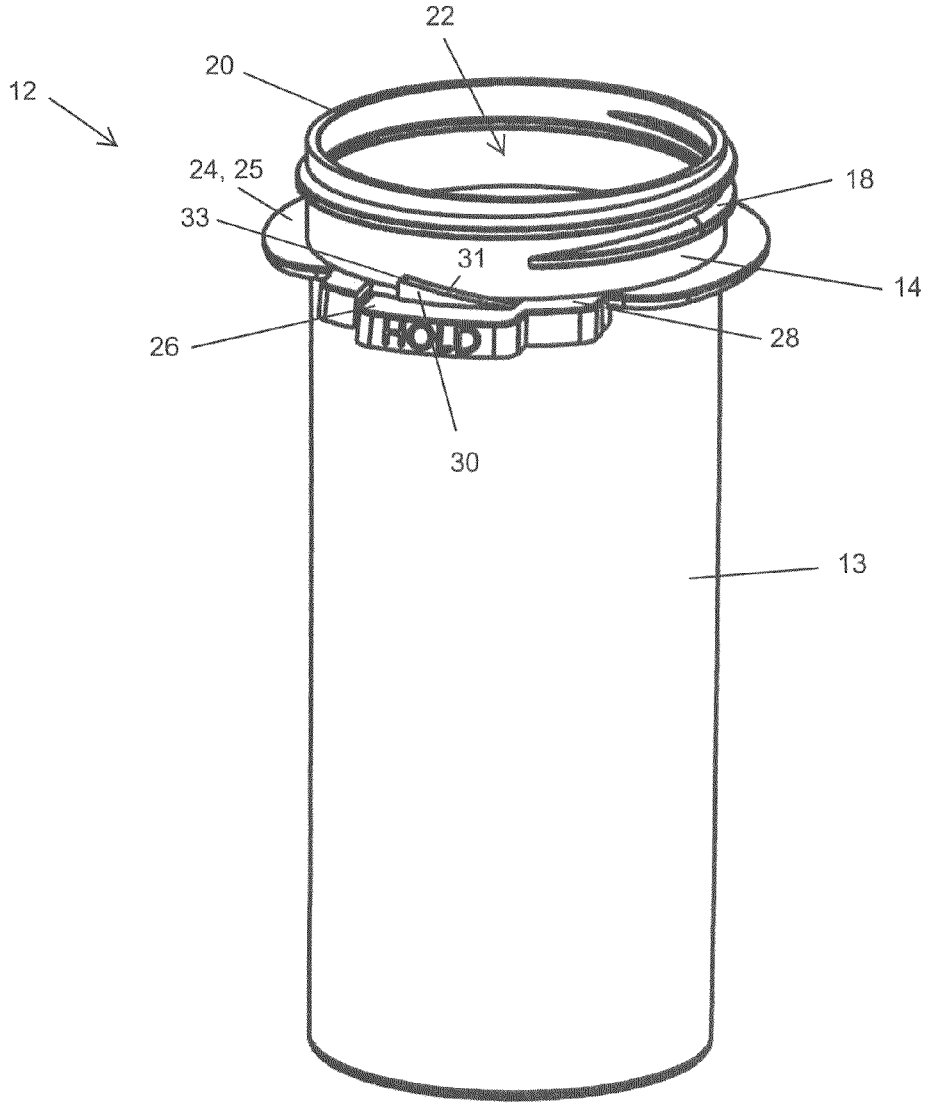
FIG. 2 is a side perspective view of a container of a reversible child resistant closure system according to one embodiment of the disclosure.

Referring to FIG. 2, the container 12 includes a body 13 and a neck 14. The neck 14 includes a container engaging structure 18 disposed on an exterior of the neck 14, a container opening edge 20 defining a container opening 22, and a bottom edge 24 opposite the container opening edge 20. In preferred embodiments, the bottom edge 24 of the neck 14 is defined by a rim 25. In some embodiments, the neck 14 may have substantially the same diameter as the body 13. However, in other embodiments, the neck 14 may have a smaller diameter than the body 13 of the container 12. The engaging structure 18 is operable to interact with a corresponding structure on the reversible child resistant closure 40 to secure the closure 40 to the container 12. In preferred embodiments, as shown in FIG. 2, the engaging structure 18 includes one or more threads. However, other suitable engaging structures 18 may be used including beads, cams, lugs and the like.

Disposed adjacent the bottom edge 24 of the neck 14 is a container locking mechanism configured to interact with a corresponding closure locking mechanism for preventing axial movement of the closure 40 when the closure system 10 is in the child resistant mode.

As shown in FIG. 2, one embodiment of the container locking mechanism includes one or more deflectable locking structures 26 disposed at an interruption of space in the rim 24. A locking lug 30 extends from a top surface 28 of the locking structure 26 towards the opening edge 20 of the container 12 for releasably engaging a corresponding locking lug of the reversible child resistant closure 40. For clarification purposes, the locking lug 30 of the container 12 is referred to herein as a locking tab, and the corresponding locking lug of the closure 40 is referred to as a locking projection. In order for the locking tab 30 to releasably engage the corresponding locking projection of the closure 40, the locking structure 26 is yieldable or deflectable relative to the neck 14. This deflection of the locking structure 26, as will be further described below, allows for engagement or disengagement of the locking tab 30 from the locking projection of the closure 40 to allow for either child locking or disengagement of the closure 40 with respect to the container 12. For ease of manufacturing of a container having the deflectable locking structure 26, the container 12 is preferably injection molded. However, it should be noted that other types of locking mechanisms may be utilized within the scope of the disclosure including locking mechanisms for blow molded containers.

Referring to FIGS. 3A-3D and FIGS. 4A-4D, the one piece closure 40 includes a first section 42 having a first edge 44 and a second section 46 having a second edge 48. The first section 42 and second section 46 are separated by a solid divider 50 which prevents pharmaceuticals or other materials from exiting the opening 22 of the container 12 whether the one piece closure 40 is used in a child resistant configuration or a non-child resistant configuration. A circumferential side wall 52 extends around the outer circumference of the closure 40 extending from the first edge 44 of the first section 42 to the second edge 48 of the second section 46. The solid divider 50 and side wall 52 forms a first section cavity 43 extending between the first edge 44 and the divider 50 and a second section cavity 47 extending from the second edge 48 to the divider 50. As shown, the diameter of the circumferential side wall 52 is preferably substantially the same throughout the height of the closure 40.

The exterior surface 53 of the side wall 52 preferably includes a gripping structure such as a plurality of knurls 55 for assisting a user to grip and rotate the closure 40 relative to the container 12. The interior surface 54 of the side wall 52 of both the first section 42 and the second section 46 includes respective engaging structures 56, 58 operable to interact for rotatable engagement with the complementary engaging structure 18 on the container 12 to secure the closure 40 to the container 12. Referring to FIG. 1A, when the closure 40 is applied to the container 12 in the child resistant configuration, engaging structure 58 of the closure 40 interacts with the engaging structure 18 of the container 12.

Referring to FIG. 1B, when the closure 40 is inverted and applied to the container in the non-child resistant configuration, engaging structure 56 of the closure 40 interacts with the engaging structure 18 of the container 12. As shown in the Figures, the engaging structures 56 and 58 are preferably solid or segmented threads. However, other suitable engaging structures 56, 58 may be used as long as they are operable to interact with the engaging structure 18 of the container 12.

Figure 6:
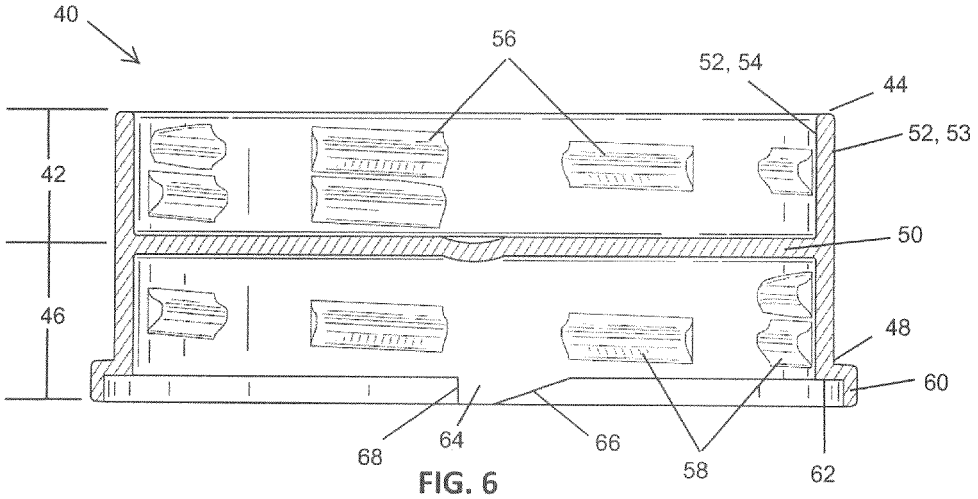
FIG. 6 is a side cross-sectional view of the closure according to one embodiment of the disclosure.

In the embodiment shown in FIGS. 3A-3D, both of the engaging structures 56 and 58 of the closure 40 includes a segmented thread for interacting with the threaded engaging structure 18 of the container 12. To assist in manufacturing the closure 40 of this embodiment, the thread segments 56 of the first section 42 are preferably vertically aligned with the thread segments 58 of the second section 46 as shown in the cross-sectional view of FIG. 6. Lifter bars are preferably used to make the segmented threads 56, 58 in an injection molding process.

In an alternate embodiment, as shown in FIGS. 4A-4D, the engaging structure 56 of the first section 42 is a single continuous thread while the engaging structure 58 of the second section 46 is a segmented thread. In this embodiment, during manufacture, the thread segments 58 of the second section 46 are preferably made using lifter bars, and the lifter bars will pull on the thread segments 58 of the second section to bump the closure 40 off the mold. The thread segments 58 of the second section 46 are preferably between about 0.75 inches to about 1.25 inches long depending on the size of the closure 40. However, as shown in FIGS. 3A-3D, smaller thread segments may be used for either the first section 42 or the second section 46.

Figure 3A:
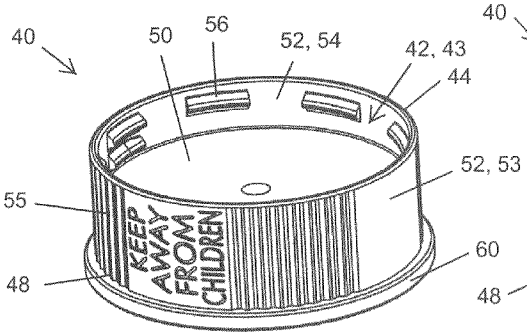
FIGS. 3A-3D are side perspective views of a closure of a reversible child resistant closure system according to one embodiment of the disclosure, oriented with a non-child resistant section located on the top and a child resistant section located on the bottom according to one embodiment of the disclosure.
Figure 3B:
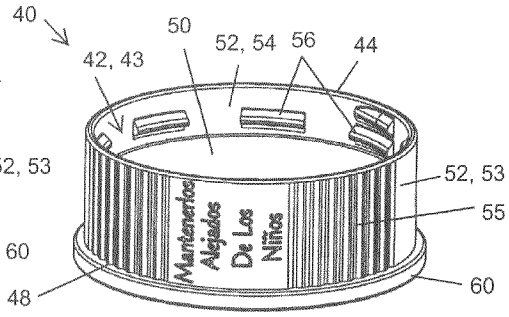
Figure 3C:
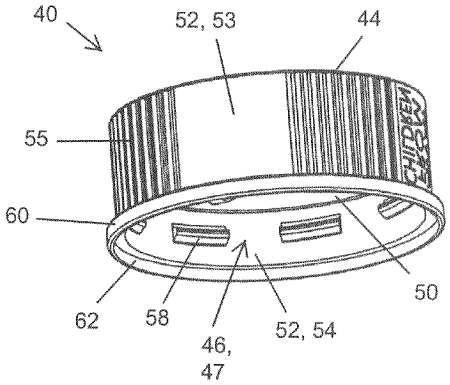
Figure 3D:
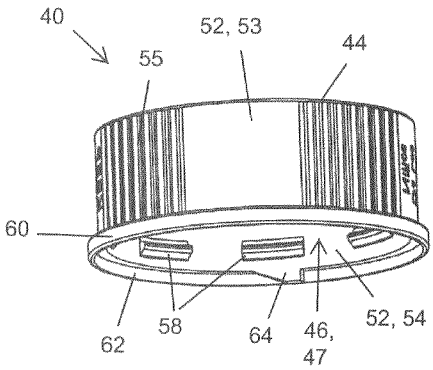
Figures 4A, 4B:
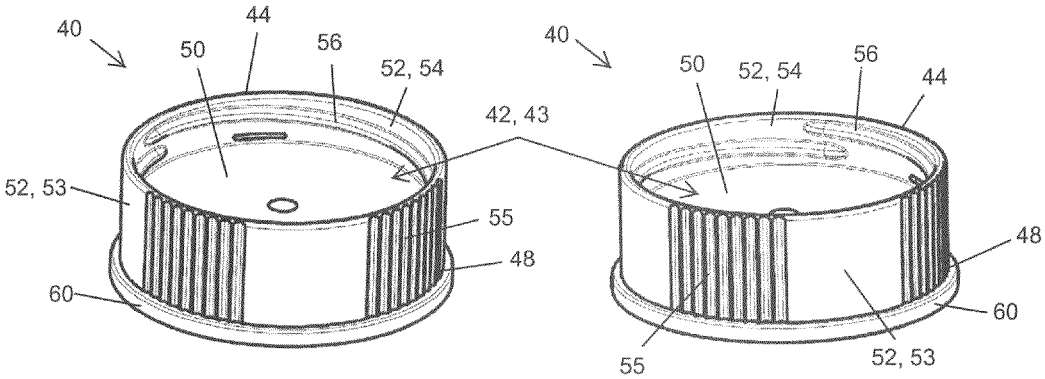
FIGS. 4A-4D are side perspective views of a closure of a reversible child resistant closure system according to one embodiment of the disclosure, oriented with a non-child resistant section located on the top and a child resistant section located on the bottom according to another embodiment of the disclosure.
Figures 4C, 4D:
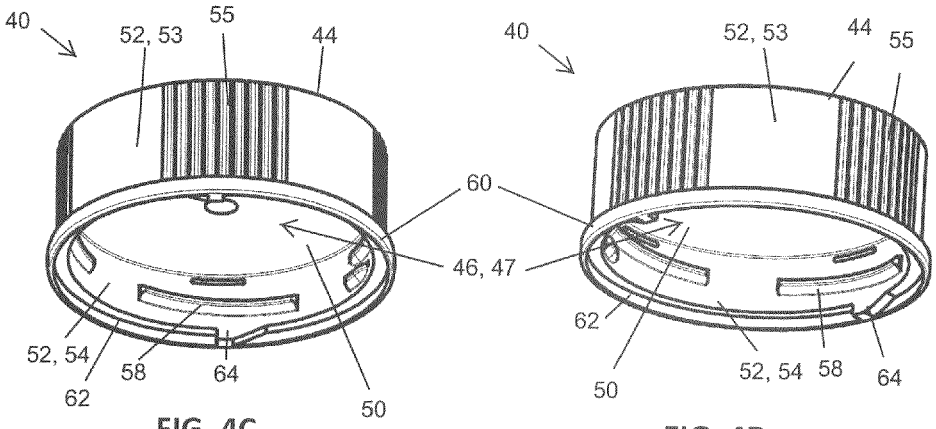

Referring to FIGS. 3D and 4D, the second section 46 includes a flange 60 extending radially from the side wall 52 axially downward from the second edge 48. At least one locking projection 64 extends radially inward from the inner surface 62 of the flange 60. The locking projection 64 is operable to engage the locking tab 30 of the container 12 for preventing the closure 40 from rotating with respect to the container 12. When the closure 40 is applied to the container 12 in the child resistant configuration and the locking projection 64 of the closure 40 engages the locking tab 30 of the container 12, the closure system 10 is in the child resistant mode. In order to remove the closure 40 from the container 12, a user must deflect the locking structure 26 so that the locking projection 64 disengages the locking tab 30. For example, the locking structure 26 may be deflected downward by a thumb of the user.

Figure 5:
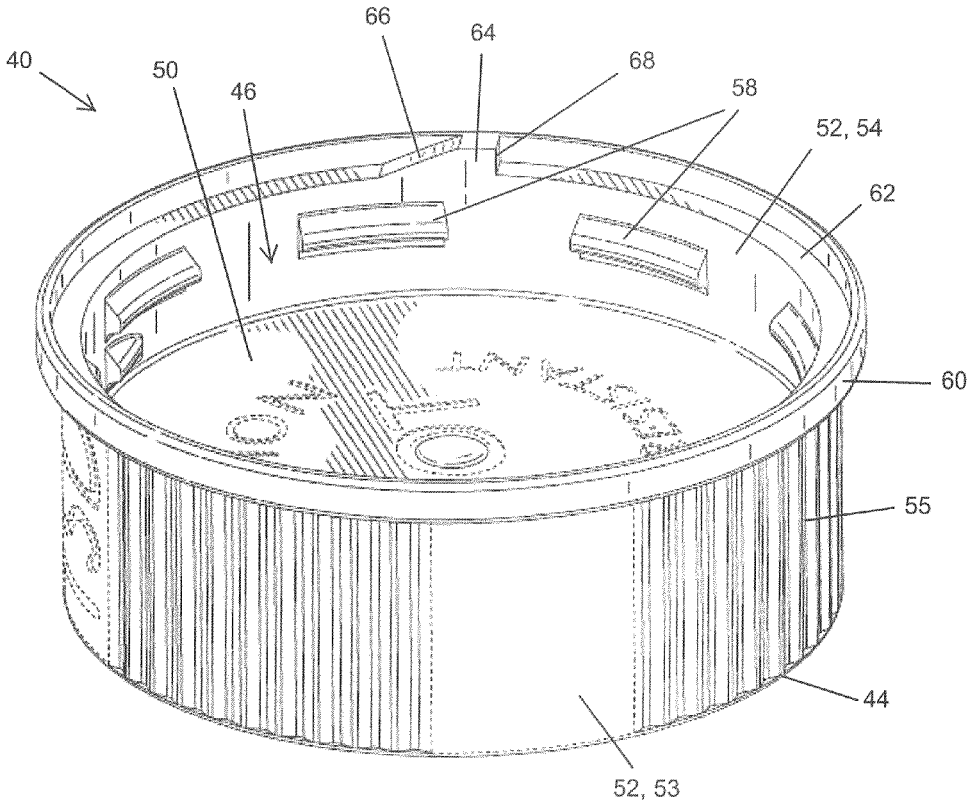
FIG. 5 is a perspective view of the closure oriented so that the child resistant side is facing upward according to one embodiment of the disclosure.
Figure 7:
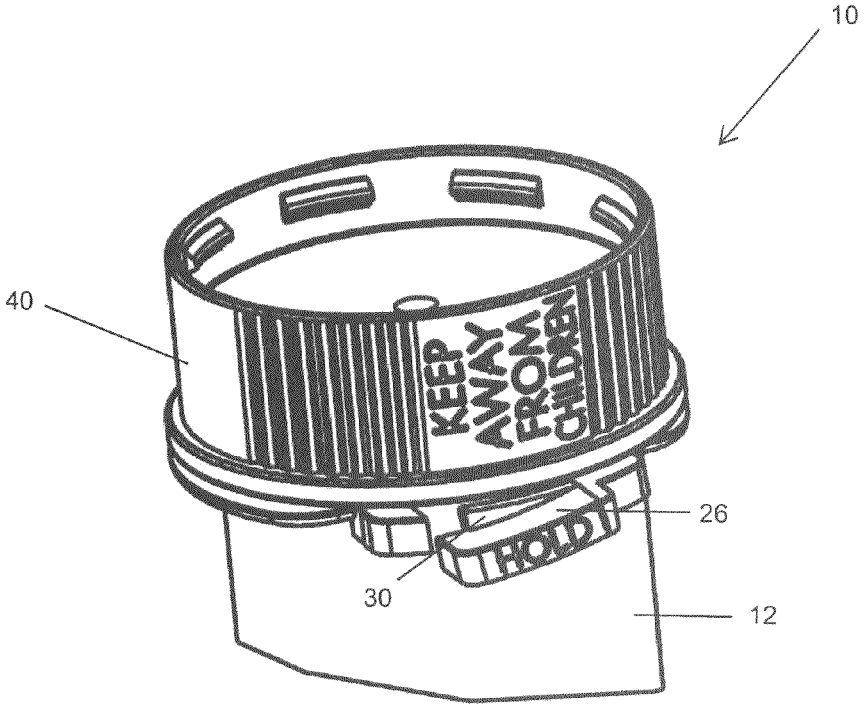
FIG. 7 is side perspective view of the closure being applied to a container in the child resistant configuration according to one embodiment of the disclosure.

In certain embodiments, as shown in FIG. 2, the locking tab 30 of container 12 includes a ramp or inclined surface 31 and a locking edge 33. Referring to FIG. 5, the locking projection 64 of closure 40 also includes a ramp or inclined surface 66 and a locking edge 68. In operation, the closure 40, when applied to the container 12 in the child resistant configuration, is rotated in a closing direction, preferably clockwise, about the neck 14 of container 12 until the locking projection ramp 66 traverses the locking tab ramp 31. Referring to FIG. 7, to assist the locking projection ramp 66 in traversing the locking tab ramp 31, the locking structure 26 and corresponding locking tab 30 of the container 12 is deflected downward as the locking projection ramp 66 travels across the locking tab ramp 31.

Figure 8:
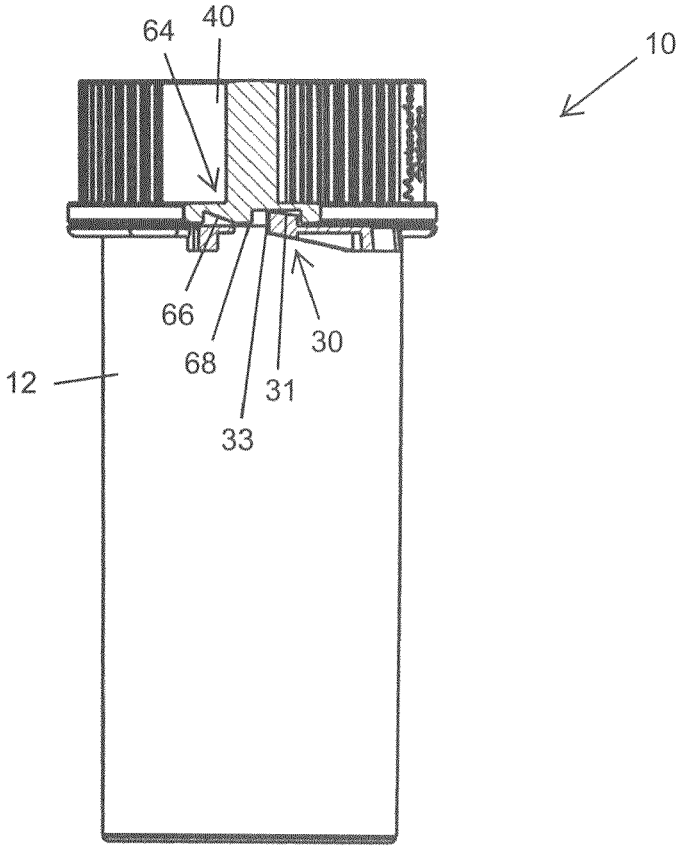
FIG. 8 is side cross-sectional view of a reversible child resistant closure system in the child resistant mode according to one embodiment of the disclosure.

Referring to FIG. 8, showing a cross-sectional view of the closure system 10 in the child resistant mode where the locking projection 64 is engaging the locking tab 30, the locking edge 33 of the locking tab 30 and the locking edge 68 of the locking projection 64 prevent the closure 40 from rotating in an opening direction, the opening direction preferably being counter-clockwise. In order to allow counter-clockwise rotation of the closure 40 for removing the closure 40 from the container 12, a user holds down or otherwise deflects the locking structure 26 so that the locking projection 64 may traverse the locking tab 30.

In a non-child resistant operation, the closure 40 is inverted 180 degrees so that it may be applied to the container 12 in the non-child resistant configuration as shown in FIG. 1B. As the first section 42 of the closure 40 does not include a locking tab or any other type of structure that would engage the locking structure 26 of the container 12, the closure 40 is operable to freely move in both a clockwise and counter-clockwise direction.

Figure 9:
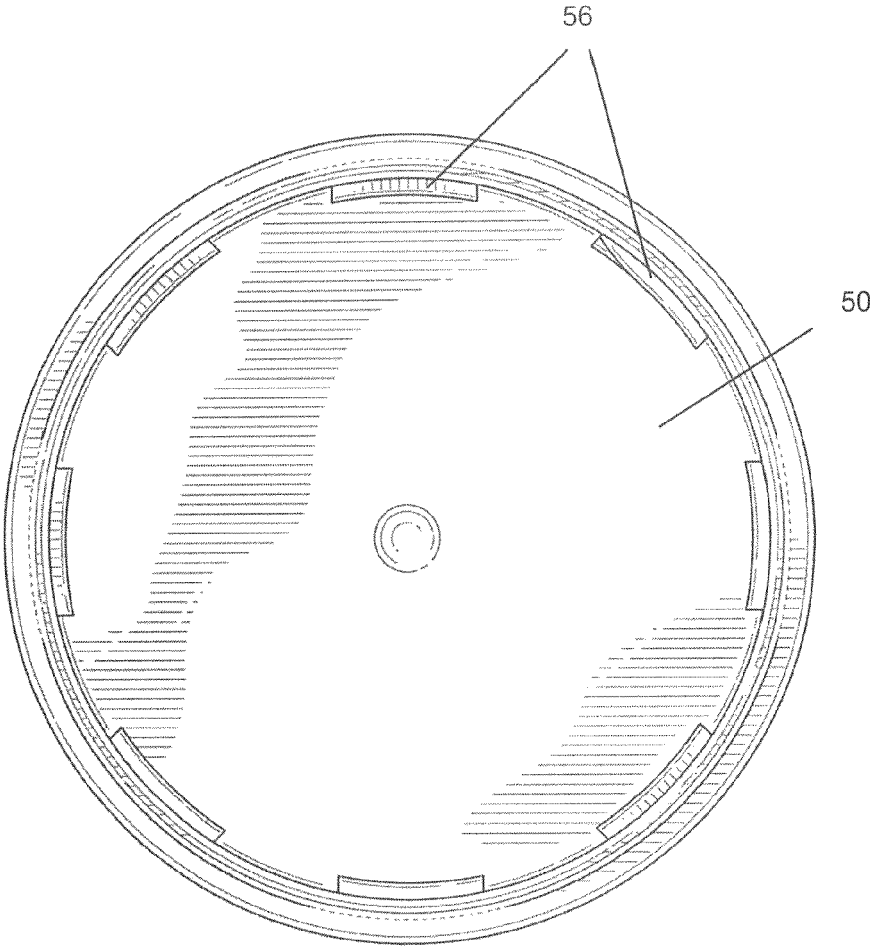
FIG. 9 is a top plan view of the closure with the non-child resistant side facing up according to one embodiment of the disclosure.
Figure 10:
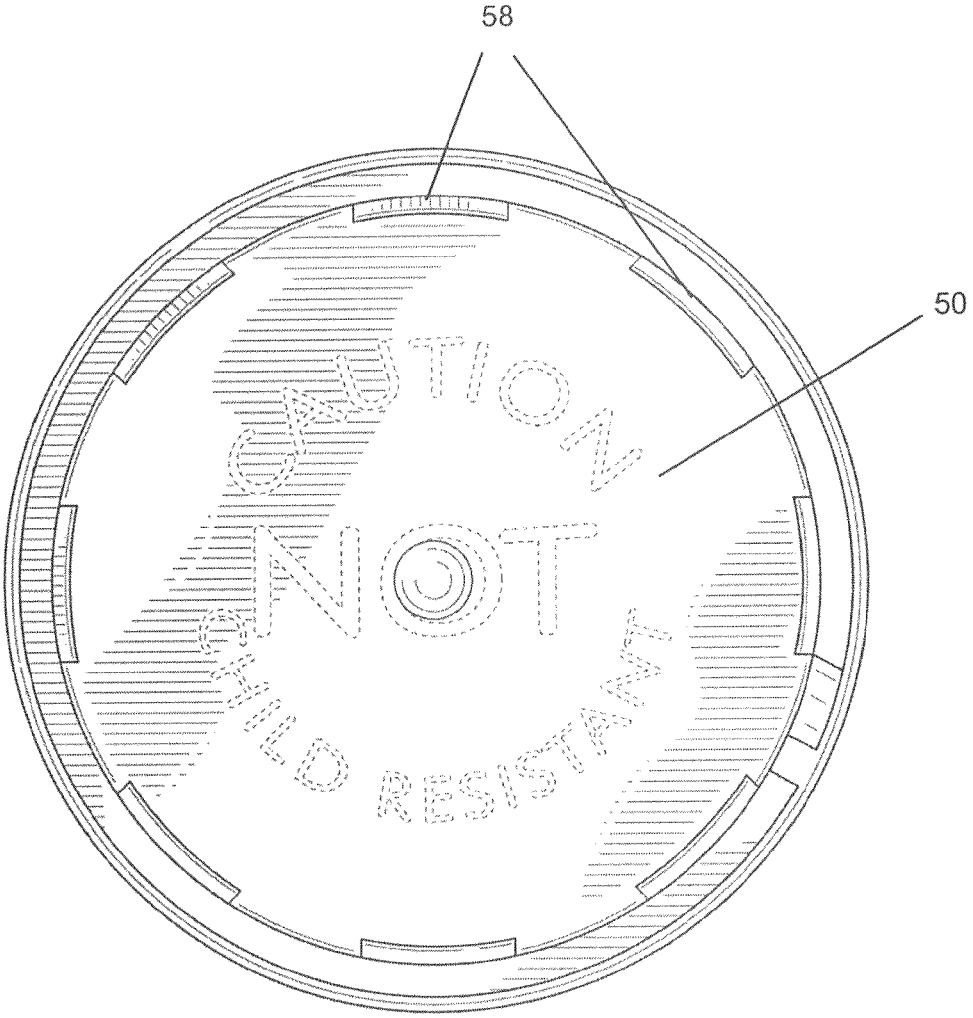
FIG. 10 is a top plan view of the closure with the child resistant side facing up according to one embodiment of the disclosure.

Referring to FIGS. 9-10, the divider 50 is seen from above when the closure system 10 is in either the child resistant mode (FIG. 9) or the non-child resistant mode (FIG. 10). Indicia, such as company branding, may be molded into one or both sides of the divider 50. As shown in FIG. 10, a warning that closure system 10 is in the non-child resistant mode is preferably molded into the second section side of the divider 50 such that the warning is visible when the closure system 10 is in the non-child resistant mode.

As explained above, the divider 50 disposed between the first section 42 and second section 46 forms a first section cavity 43 and a second section cavity 47. Thus, each cavity is configured to easily receive liner inserts 70 for providing information to the user of the child resistant closure system 10. The liners 70 are preferably shaped in the form of a disc so that they may be positioned adjacent to and parallel the divider 50 in the first section 42, the second section 46, or both the first section 42 and the second section 46 of the closure 40. To easily secure the liners without glue or other adhesives, the liners preferably include a diameter that is substantially the same as the diameter of the side wall 52.

Referring to FIGS. 11A-11D, a first liner 72 is inserted into the first section cavity 43 such that the first liner is viewed when the closure system 10 is in the child resistant mode, and a second liner 74 is inserted into the second section cavity 47 such that the second liner 74 is viewed when the closure system 10 is in the non-child resistant mode. Thus, a liner 70 is able to be displayed to a user of the closure system 10 no matter which configuration, child resistant or non-child resistant, the closure 40 is applied to the container 12. When inserted into a section cavity, the liner would cover up any information that is molded into the respective side of the divider 50. Alternatively, the use of liners 70 could replace the step of molding or printing information into the actual divider 50.

Figure 11A:
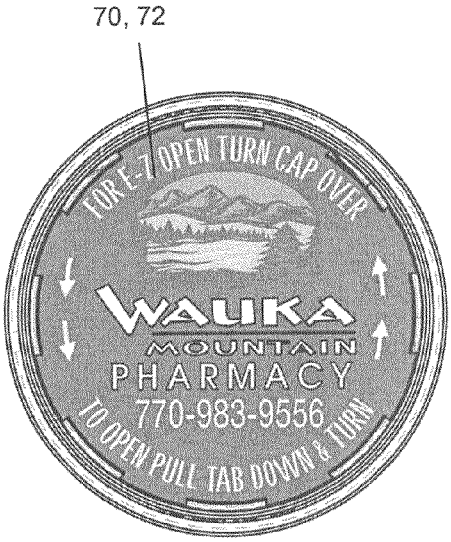
FIGS. 11A-11D are top views of the closure having various liner inserts according to embodiments of the disclosure.
Figure 11B:
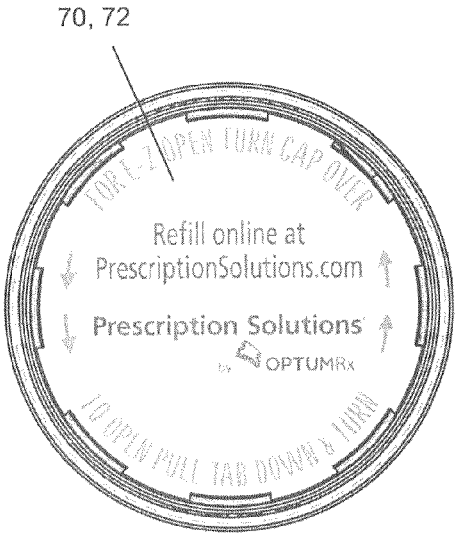

Printed on each liner 70 may be information that includes, for example, one or more of company branding, messages, advertisements, QR (quick response) codes, and prescription information. Referring to FIG. 11A, the first liner 72 is shown having promotional information in the form of pharmacy branding as well as operating instructions instructing the user, for example, "TO OPEN PULL TAB DOWN & TURN" and directing the user to turn the cap over for operating in the non-child resistant mode. Referring to FIG. 11B, another embodiment of the first liner 72 depicts promotional information directing the user to a website for refilling prescriptions as well as the operating instructions shown in FIG. 11A.

Figure 11C:
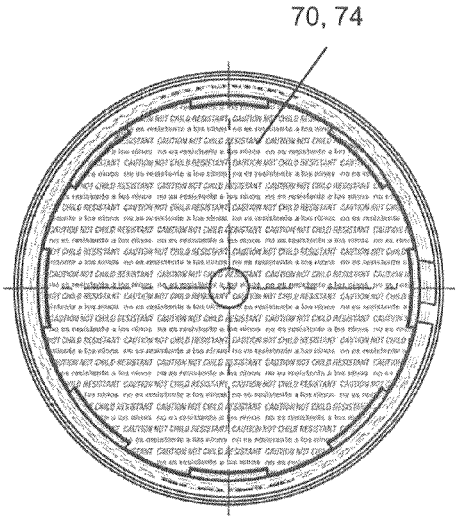
Figure 11D:
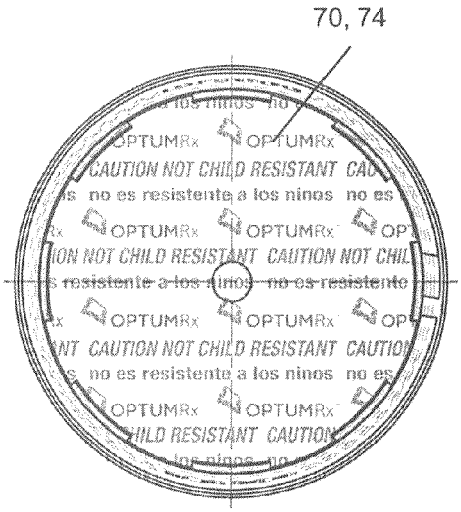
Figure 12A:
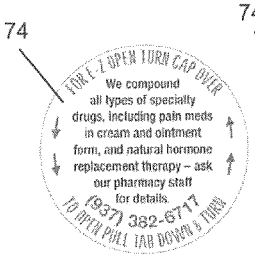
FIGS. 12A-12D are top views of various liner inserts according to embodiments of the disclosure.
Figure 12B:
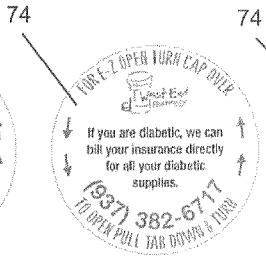
Figure 12C:
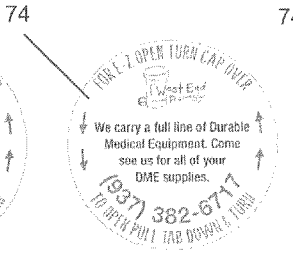
Figure 12D:
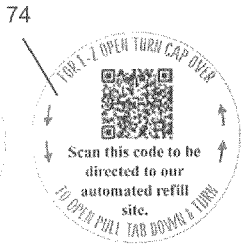

Referring to FIGS. 11C-11D, the second liner 74 is preferably provided with warning indicia, for example, "CAUTION NOT CHILD RESISTANT," for indicating to the user that the child resistant closure system 10 is currently in the non-child resistant mode. As shown in FIG. 11D, other information may also be provided in addition to the warning indicia such as pharmacy branding or other promotional materials.

Referring to FIGS. 12A-12D, various non-limiting examples of advertisements or promotional material capable of being displayed on a liner insert 70 are shown. While the liners 70 shown are first liners 72 to be inserted in the first section cavity 43 as they include operating instructions, the promotional material may also be provided on second liners 74 to be inserted in the second section cavity 47 by replacing the operating instructions with warning indicia. As shown, the liners 70 may include advertisements specifically directed to goods or services that are related to the pharmaceutical in the container, or the advertisement can be specifically directed at items that the user may associate with the pharmaceuticals dispensed in the closure system 10. For example, advertisements directed at diabetic testing equipment can be positioned on a pharmaceutical container that carries a prescription of diabetic medicine therein. As such the advertisements can be user specific.

Alternately, the advertisements can be general to a specific location such as local businesses within a predetermined distance of the pharmacy or the actual pharmacy where the closure system 10 was purchased. Specific items can be advertised, such as specials for a particular business, such as the pharmacy where the closure system 10 was purchased. Additionally, codes, such as QR codes, can be added to the advertising. These codes can be scanned by a user's smart phone or other code scanner to direct them to pharmacy web pages, coupons, etc. accessible over the Internet.

In addition to the promotional material, or in replacement of the promotional material, the liner 70 may also include prescription information directed specifically to the medication provided in the closure system. For example, the liner 70 may include an identification of the pharmaceutical stored in the closure system, compliance/dosage information such as "Take One Pill A Day," and/or auxiliary information such as "Do Not Take With Dairy." For example, referring to FIG. 13, exemplary compliance liners 70 are shown having various dosage instructions printed thereon such as "REMINDER: TAKE ONE PILL EVERY MORNING" and "REMINDER: TAKE 1 PILL EVERY 8 HOURS FOR PAIN." As shown, some of the inserts may also include operating instructions, warning information, and/or an identification of the prescribed pharmaceutical. In preferred embodiments, the inserts come in pairs such that one of the liners is for inserting into the second section 46 (having warning information indicating the closure is in the non-child resistant mode) and the other in the first section 42 of the closure 40. Further, many different inserts are preferably provided having a variety of different dosage instructions where a liner insert 70 may be chosen that correctly displays the dosage instructions for a particular pharmaceutical prescription. In an alternate embodiment, the correct dosage instructions may be printed on the liner inserts 70 by the pharmacy when filling the prescription. In certain embodiments, the variety of liners 70 may be provided each in a different color that corresponds to particular dosage instructions for the prescribed pharmaceutical in order to further enhance compliance with a prescription. For example, one liner 70 may include the instructions such as "REMINDER: TAKE 2 PILLS IN THE A.M.," and this liner would have green characters. Another liner 70 may be provided for a separate prescription that provides "REMINDER: TAKE 2 PILLS IN THE P.M.," and this liner could have red characters to distinguish it from the prescription that is to be taken in the morning.

According to an alternate embodiment, the divider 50 is made of a clear plastic or other see-through material and the side wall 52 is preferably made from a substantially opaque material or matte finish. In this embodiment, the closure 40 is preferably formed as a unitary one piece structure using a two stage injection molding process in which the opaque side wall 52 resin is injected separately from the transparent divider 50. In another embodiment, the difference in transparency between the divider 50 and the side wall 52 is controlled by using only a single stage injection process and varying the surface finish on the mold itself. Thus, the steel of the mold that forms the divider 50 would be highly polished (yielding a clear, see-through portion) while the steel forming the side wall 52 would be left rough (yielding a matte, opaque finish). The opaque side wall 52 prevents visibility of the interface of the engaging sections to inhibit opening by children who might be able to see the interference if the entire cap was transparent. In this embodiment, liner 70 may include warning indicia on one side of the liner 70 with or without additional information on the opposite side. As the divider 50 is see-through or at least partially transparent in this embodiment, one side of the liner 70 is always visible no matter which configuration the closure 40 is applied to the container 12. Accordingly, the liner 70 may be inserted into either the first section 42 or the second section 46 such that the side of the liner having warning indicia printed thereon is displayed while looking down on the closure 40 when the child resistant closure system 10 is in the non-child resistant mode, and the other side, preferably having the additional information printed thereon, is displayed when the child resistant closure system 10 is in the child resistant mode.

In automatic filling applications, the liner inserts 70 are preferably printed digitally with variable data so that the graphics and/or message of the displayed on the liner may be changed rapidly during the printing process. During manufacturing of the closures 40, the various liner inserts 70 may then be inserted into the caps randomly or in sequence in such a way that boxes of closures 40 are filled having liner inserts 70 having numerous different displays. In this manner, every single closure in a case ordered by a pharmacy may potentially have a different liner insert 70 with different printed information to be directed to the user of the closure system 10 without substantially increasing the cost per cap. For example, a pharmacy can order a box of 1000 closures having, up to 1000 different advertising or prescription information messages specifically tailored to that particular pharmacy by providing 1000 different messages selected by the pharmacy on the liner inserts 70. The pharmacist may then choose which closure should be used to fill the prescription based on the message the pharmacist would like to provide to the patient.

The liner inserts 70 may also be printed "on demand" by the pharmacist or provided to the pharmacist for selectively applying to a closure when filling a prescription. In embodiments in which the inserts are printed at the pharmacy, a pharmacy computer preferably includes a database of various liner graphics and information, the graphics/information being chosen from liners 70 substantially as described above. When filling a prescription, the pharmacist chooses one or more of the designs from the database to be printed on the liners. In preferred embodiments, the liners 70 will be printed on a label sheet also including labels having prescription information that is typically applied to the body 13 of the container 12. Alternatively, numerous liners 70 containing different graphics and information are pre-printed by the pharmacist or provided to pharmacist by a third party. In either of these manners, the pharmacist can choose from a variety of different inserts having various information based on such factors as the patient, the type of prescription, current promotions, etc., and the pharmacist can selectively apply inserts 70 to the closure 40 when filling the prescription.

In another aspect of the closure system 10, the divider 50 is disposed between the first section 42 and second section 46 such that the divider 50 forms a close fit around the opening edge 20 and opening 22 of the container 12 whether the reversible child resistant closure system 10 is in the child resistant mode or the non-child resistant mode. Further, no part of the closure 40 traverses or extends into the opening 22 whether the reversible child resistant closure system 10 is in the child resistant mode or the non-child resistant mode. Accordingly, the present disclosure provides a one piece reversible child resistant closure system 10 that may be used in conjunction with an induction sealing system for providing a tamper resistant seal to the closure system 10. In operation, a tamper resistant liner is inserted into one of the sections 42, 46 of the closure 40. The closure 40 is then applied to the container 12 in the desired configuration, and the closure system 10 is passed through an induction sealing machine for sealing the tamper resistant liner to the opening edge 20 of the container 12.

Figure 14:
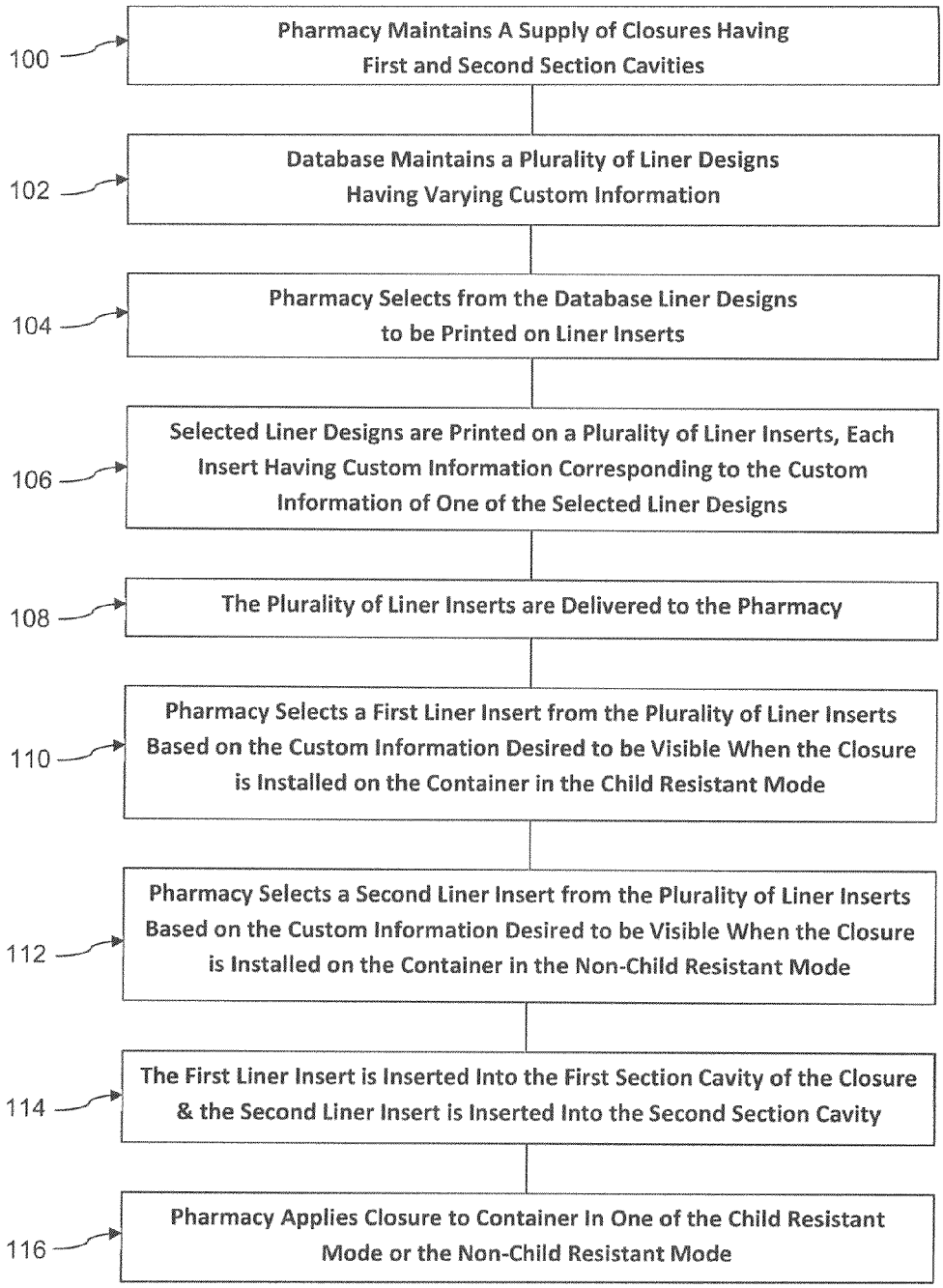
FIG. 14 is a flow chart of a method of printing and applying custom label inserts to a closure according to embodiments of the disclosure.

Referring to FIG. 14, a flow chart of an exemplary method of the present disclosure for printing and applying custom label inserts to a closure 40 is depicted. It should be understood that the following steps are not required to be performed in any particular order, and, in certain embodiments, one or more of the steps may be omitted. The method of FIG. 14 and each of the alternate embodiments described below provide for the custom printing of liner inserts to be used on a reversible child resistant closure system such that the custom information of a liner insert is viewable to a user of the closure system when the closure is installed on the container in both the child resistant mode and the non-child resistant mode. Further, the custom information of the liner insert that is viewable when the closure is installed on the container in the child resistant mode may be substantially the same or different than the custom information of the liner insert that is viewable when the closure is installed on the container in the non-child resistant configuration.

In step 100, a pharmacy is provided and maintains a supply of reversible child resistant closure systems 10 including a supply of closures 40 substantially as described above. The term pharmacy is used herein to refer to any entity that fills pharmaceutical prescriptions and medications into closure systems. However, it should be understood that similar methods could be performed by other users of the reversible child closure systems 10 irrespective of the contents of the container 12.

Referring to step 102, a database is maintained having a plurality of liner designs, each design having varying custom information. The custom information of the liner designs typically includes the information options substantially as described above with respect to the liner inserts 70. In particular, the liner designs may include one or more of the following: promotional information such as company branding, advertisements, and coupons; prescription information such as the name of the prescribed pharmaceutical or dosage/compliance instructions; warning information indicating the closure 40 is in the non-child resistant configuration; and/or operating instructions for applying/removing the closure 40 to the container 12. The database in step 102 is preferably accessible in a computer system maintained by the pharmacy or maintained by a third party with the pharmacy having access to the third party database.

In step 104, the pharmacy selects from the database particular liner designs to be printed on liner inserts. The selections are made by the pharmacy based at least in part on the custom information the pharmacy determines it may want to provide to users of the reversible child resistant closure systems 10. For example, if the pharmacy would like the option of providing to users of certain prescribed pharmaceuticals information on the closure 40 pertaining to dosage instructions (i.e., "REMINDER: TAKE 2 PILLS A DAY"), the pharmacy will select at least one liner design having the applicable dosage instructions. If the pharmacy determines to provide its branding on the closure 40 in certain circumstances, it will select at least one liner design having the applicable branding.

In step 106, the selected liner designs are printed on a plurality of the liner inserts 70 (discussed above). Each insert includes custom information corresponding to the custom information of one of the liner designs selected in step 104. In certain embodiments, the liner inserts are printed by the pharmacy. When the liner inserts are printed by a third party, the liner inserts are delivered to the pharmacy in step 108.

In step 110, the pharmacy selects a first liner insert to be inserted in the closure from the plurality of liner inserts based on the custom information desired to be visible when the closure 40 is installed on the container in the child resistant mode. In certain embodiments, numerous inserts having many different types of custom information are provided to the pharmacy in step 108. As such, the pharmacist has many types of inserts to choose from when filling a prescription. For example, the plurality of liner inserts may include a liner insert having branding of the pharmacy displayed thereon, a coupon or advertisement for goods and services offered by the pharmacy, an advertisement for a company geographically located proximate to the pharmacy, dosage instructions relating to the pharmaceutical being prescribed, and the like. The pharmacist may then select from the plurality of liner inserts which message he would like to provide to the user of the pharmaceutical prescription when the closure 40 is applied to the container 12 in the child resistant mode.

Similarly, in step 112, the pharmacy selects a second liner insert from the plurality of liner inserts based on the custom information desired to be visible to the user of the pharmaceutical storage system when the closure 40 is installed on the container in the non-child resistant mode. In preferred embodiments, the second liner insert will include warning information indicating that the closure system is in the non-child resistant mode. As such the plurality of liner inserts includes a group of inserts all having such warning information to be inserted in the second section cavity. As shown in FIG. 11D, this group of inserts preferably also includes additional custom information as described above. The custom information of the second liner insert may be similar to the custom information of the first liner insert, or the first and second liner inserts may have entirely different respective messages. For example, the first liner inset may include dosage information for the prescribed pharmaceutical while the second liner insert includes promotional information such as a QR code to be scanned. Alternatively, both the first liner insert and the second liner insert may include the same dosage instructions for the prescribed pharmaceutical and/or the same promotional information such as company branding.

In step 114, the first liner insert is inserted into the first section cavity and the second liner insert is inserted into the second section cavity of the closure 40. In step 116, the pharmacy applies the closure 40 to the container 12 in one of the child resistant mode or the non-child resistant mode. When the closure 40 is applied to the container 12 in the child resistant mode, the custom information of the first liner insert will be displayed to the user of the system 10. When the closure 40 is applied to the container 12 in the non-child resistant mode, the custom information of the second liner insert will be displayed to the user of the system 10.

In an alternate method of the disclosure where the database of liner designs is maintained by a third party, the pharmacy selects from the database the liner designs to be printed on the liner inserts as described above in regards to steps 104 and 106. However, instead of the liner inserts being delivered to the pharmacy in step 108 and the pharmacy inserting the liner inserts in steps 110 and 112, the third party inserts the selected liner designs into the appropriate section cavities of a plurality of closures 40 for the pharmacy. As described above, in automatic filling applications, the liner inserts are preferably printed digitally with variable data so that the graphics and/or message of the displayed on the liner may be changed rapidly during the printing process. The liner inserts may then be inserted into the closures randomly or in sequence in such a way that boxes of closures are filled having liner inserts 70 having numerous different liner designs. The closures 40 are then delivered to the pharmacy with the selected liner inserts already installed in the closures 40.

In another alternate method of the disclosure, the pharmacy prints the selected liner designs for the first and second liner inserts "on demand." In other words, the liner inserts having desired custom information are printed when filling a prescription as opposed to being selected from pre-printed inserts. In this embodiment, the liner designs may be selected from the database and printed at the pharmacy when filling the prescription. Alternatively, certain liner designs from the database may be preprogrammed to be printed by the computer system based on the pharmaceutical prescription being filled. For example, when a prescription is being filled for diabetes equipment, the computer system may be programmed to print inserts having an advertisement for diabetic equipment or supplies. In certain embodiments, the liner inserts are included on a label sheet that also includes the labels to be applied to the circumference of the container. In other embodiments, the liner inserts are printed separately from the label sheets.

Figure 13:
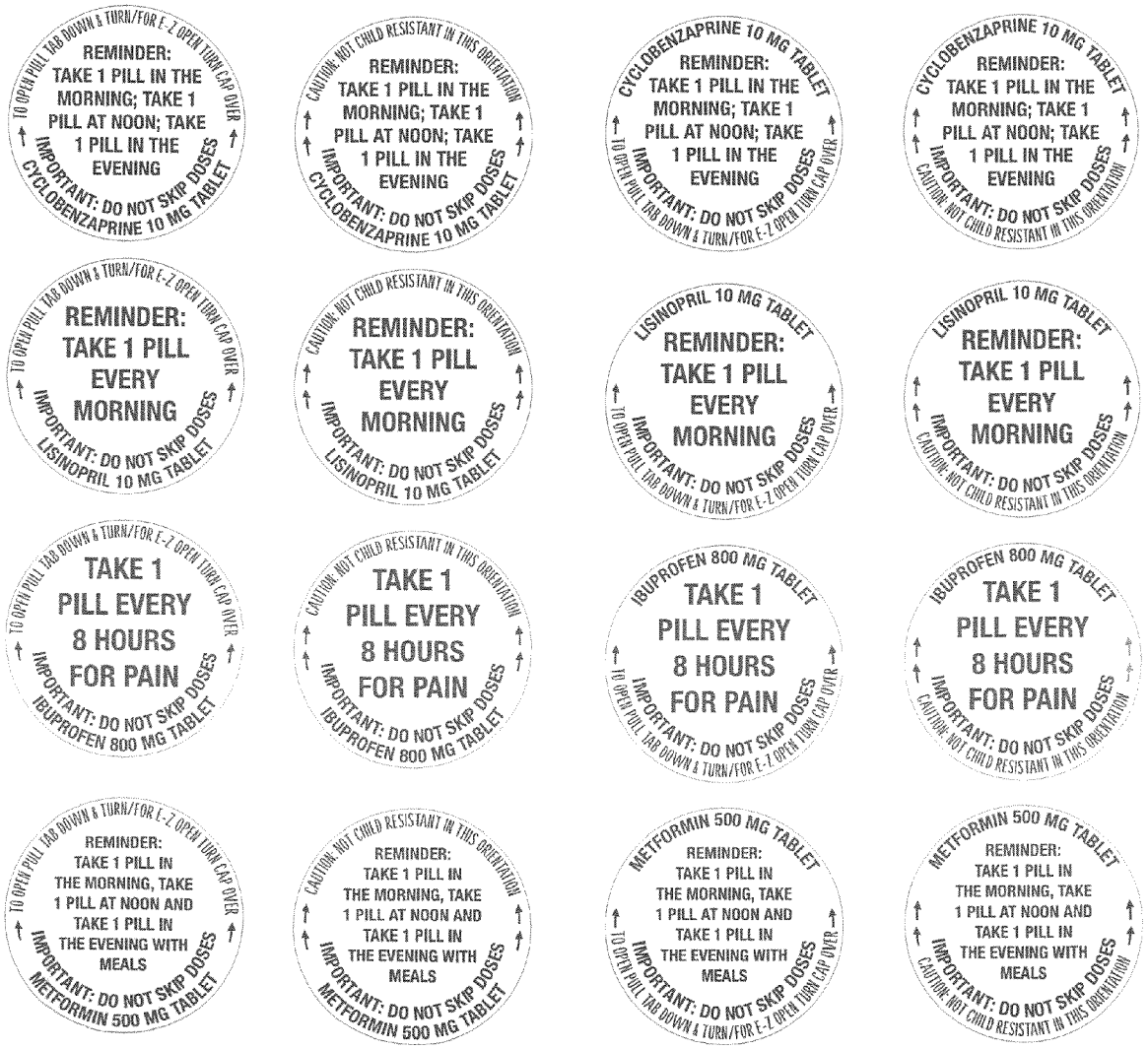
FIG. 13 is a top view of various compliance liner inserts according to embodiments of the disclosure.

A particularly useful application in which the liner designs are selected and printed on the label inserts "on demand" is when the pharmacy chooses to include dosage instructions particular to the pharmaceutical being prescribed such as the inserts shown in FIG. 13. In this embodiment, the database includes a plurality of liner designs having various dosage instructions such "REMINDER: TAKE ONE PILL EVERY MORNING," "REMINDER: TAKE 1 PILL EVERY 8 HOURS FOR PAIN," etc. When filling a prescription, the pharmacy picks a liner design from the database having the appropriate dosage instructions for the pharmaceutical being prescribed. The selected liner design is then printed on one or both of the first and second liner inserts at the pharmacy. Alternatively, the appropriate dosage instructions are automatically printed on the liner inserts when filling a pharmaceutical prescription. For example, the pharmacy selects the option to print compliance inserts when filling a prescription. The pharmacy computer then prints the appropriate dosage instructions on liner inserts ticked together on a label sheet. The pharmacist then removes the printed liner inserts and inserts them into the first and second section cavity of the closure.

In yet another method of the disclosure, the liner inserts may be printed with a first selected liner design on a first side of the insert and a second liner design on the second side of the liner insert. Such a liner insert having custom information printed on both sides may be used in embodiments of the closure 40 having a transparent center divider 50 as described above.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed:

1. A method of providing information to a user of a reversible child resistant closure operable to be applied to a container in one of a child resistant mode and a non-child resistant mode, the method comprising the steps of:

maintaining a supply of closures, each closure including:

a first section configured to be applied to the container in the non-child resistant mode, a second section configured to be applied to the container in the child resistant mode, and a divider disposed between the first section and the second section for forming a first section cavity and a second section cavity;

maintaining a database of custom liner designs, each liner design including custom information to be printed on a liner insert, the custom information including at least one of promotional information and prescription information;

configuring one of the closures of the supply to include printed information, comprising the steps of:

selecting from the database of custom liner designs a first liner design and a second liner design;

printing the first liner design having indicia on a first liner prior to inserting the first liner in the first section cavity, the indicia of the first liner corresponding to the custom information of the first liner design;

printing the second liner design having indicia on a second liner prior to inserting the second liner in the second section cavity, the indicia of the second liner corresponding to the custom information of the second liner design;

inserting the first liner having the first liner design printed thereon in the first section cavity of the closure such that the first liner design of the first liner is visible when the closure is installed on the container in the child resistant mode; and inserting the second liner having the second liner design printed thereon in the second section cavity of the closure such that the second liner design of the second liner is visible when the closure is installed on the container in the non-child resistant mode.

2. The method of claim 1 wherein the closure includes a circumferential side wall having a side wall diameter, the first liner and the second liner being shaped in the form of a disc having a liner diameter substantially the same as the side wall diameter.

3. The method of claim 1 further comprising:

selecting the first liner based on the desired custom information to be directed to the user when the closure is installed on the container in the child resistant mode; and selecting the second liner based on the desired custom information to be directed to the user when the closure is installed on the container in the non-child resistant mode.

4. The method of claim 1 wherein the custom information of the first liner design is substantially similar to the custom information of the second liner design.

5. The method of claim 1 wherein the custom information of the first liner design is different than the custom information of the second liner design.

6. The method of claim 1 wherein the custom information of at least one of the first liner design and the second liner design includes dosage instructions corresponding to a pharmaceutical being prescribed.

7. The method of claim 1 wherein the custom information of both of the first liner design and the second liner design includes dosage instructions corresponding to a pharmaceutical being prescribed.

8. The method of claim 7 wherein the dosage instructions are automatically selected by a computer system from the database based on the pharmaceutical being prescribed.

9. The method of claim 1 wherein the custom information of the second liner includes warning information indicating that the closure is in the non-child resistant mode.

10. The method of claim 1 wherein the custom information of at least one of the first liner and the second liner includes promotional information.

11. The method of claim 1 wherein the custom information of both the first liner and the second liner includes promotional information.

12. The method of claim 1 wherein the custom information of at least one of the first liner and the second liner includes prescription information.

13. The method of claim 1 wherein the custom information of both the first liner and the second liner includes prescription information.

14. A method of providing customized information to a user of a pharmaceutical storage system, the method comprising:

maintaining at a pharmacy a supply of closures, each closure including a first section configured to be applied to a container in a non-child resistant mode and a second section configured to be applied to the container in a child resistant mode, the first section including a first section cavity configured to receive a first liner insert and the second section including a second section cavity configured to receive a second liner insert;

maintaining a plurality of liner inserts each having custom information printed thereon, the custom information including at least one of warning information, promotional information, operating instructions, and prescription information; and configuring one of the closures of the supply to include custom printed information, comprising the steps of:

selecting a first liner insert from the plurality of liner inserts based on desired custom information to be directed to the user when the closure is applied to the container in the child resistant mode, selecting a second liner insert from the plurality of liner inserts based on desired custom information to be directed to the user when the closure is applied to the container in the non-child resistant mode, inserting the first liner insert in the first section cavity such that the desired custom information of the first liner insert is visible when the closure is applied to the container in the child resistant mode, and inserting the second liner insert in the second section cavity such that the desired custom information of the second liner insert is visible when the closure is applied to the container in the non-child resistant mode.

15. The method of claim 14 further comprising receiving at the pharmacy the plurality of liner inserts from a third party.

16. The method of claim 14 wherein the plurality of liner inserts includes a group of inserts including at least warning information indicating that the closure is in the non-child resistant mode and wherein the second liner insert is selected from the group of inserts.

17. The method of claim 14 wherein the plurality of liner inserts includes a group of inserts having at least dosage information for a plurality of pharmaceutical prescriptions and wherein at least one of the first and second liner inserts is selected from the group of inserts based on an appropriate dosage of a pharmaceutical prescribed to the user of the pharmaceutical storage system.

18. The method of claim 14 wherein the plurality of liner inserts includes a group of inserts having promotional information directed to one of goods or services offered by the pharmacy, goods or services that are related to a prescribed pharmaceutical, and goods or services offered by a company geographically related to the pharmacy.

19. A method of providing customized information to a user of a pharmaceutical storage system, the method comprising:

maintaining a supply of closures, each closure including at least a first section cavity configured to receive a liner insert;

maintaining a plurality of liner inserts each having custom information printed thereon, the custom information including at least one of warning information, promotional information, operating instructions, and prescription information; and configuring one of the closures of the supply to include custom printed information, comprising the steps of:

selecting a first liner insert from the plurality of liner inserts based on desired custom information to be directed to the user when the closure is applied to the container; and inserting the first liner insert in the first section cavity such that the desired custom information of the first liner insert is visible when the closure is applied to the container in one of a child resistant mode and a non-child resistant mode.

20. The method of claim 10 wherein the first liner insert is inserted into the first section cavity such that the desired custom information of the first liner insert is visible when the closure is applied to the container in the non-child resistant mode.

21. The method of claim 20 wherein each closure includes a first section, a second section, and a divider disposed between the first section and the second section, the method further comprising printing indicia on the divider such that the indicia is visible when the closure is applied to the container in the child resistant mode.

* * * * *